United States Patent [19]

Briner

[11] Patent Number: 4,864,679

[45] Date of Patent: Sep. 12, 1989

[54] APPARATUS FOR CLEANING A TEXTILE MACHINE COMPRISING A PLURALITY OF OPERATING POSITIONS

[75] Inventor: Emil Briner, Winterthur, Switzerland

[73] Assignee: Rieter Machine Works Ltd., Winterthur, Switzerland

[21] Appl. No.: 168,132

[22] Filed: Mar. 14, 1988

Related U.S. Application Data

[62] Division of Ser. No. 87,790, Aug. 21, 1987.

[30] Foreign Application Priority Data

Aug. 22, 1986 [CH] Switzerland ..... 03389/86

[51] Int. Cl.[4] ..... D01H 11/00

[52] U.S. Cl. ..... 15/312 A; 15/319; 15/339; 57/301

[58] Field of Search ..... 15/312 R, 312 A, 319, 15/339; 57/301

[56] References Cited

U.S. PATENT DOCUMENTS 4,514,972 5/1985 Stahlecker ..... 57/301
4,655,258 4/1987 Breyer et al. ..... 15/312 A X
4,756,049 7/1988 Uehara ..... 15/312 R X

FOREIGN PATENT DOCUMENTS 227056 9/1985 German Democratic Rep. ... 15/319

*Primary Examiner*—Chris K. Moore
*Attorney, Agent, or Firm*—Werner W. Kleeman

[57] ABSTRACT

A textile machine, such as a spinning machine, is suction cleaned from spinning position to spinning position by a movable programmable robot provided with a suction device. This enables individual elements of the spinning machine prone to impurity or contaminant fouling to be maintained effectively free of such impurity depositions including fiber accumulations and the like without requiring use of the heretofore employed blowing-suction fucntion. The movable programmable robot is controlled by virtue of its being programmaged such that a suction trunk or nozzle thereof is guided in such close proximity to the individual elements to be suction cleaned that the suction cleaning operation can be effectively carried out and in a short period of time, following which the movable programmable robot is moved to the next spinning position for performance of the same or desired suction cleaning operation.

13 Claims, 1 Drawing Sheet

Fig. 1
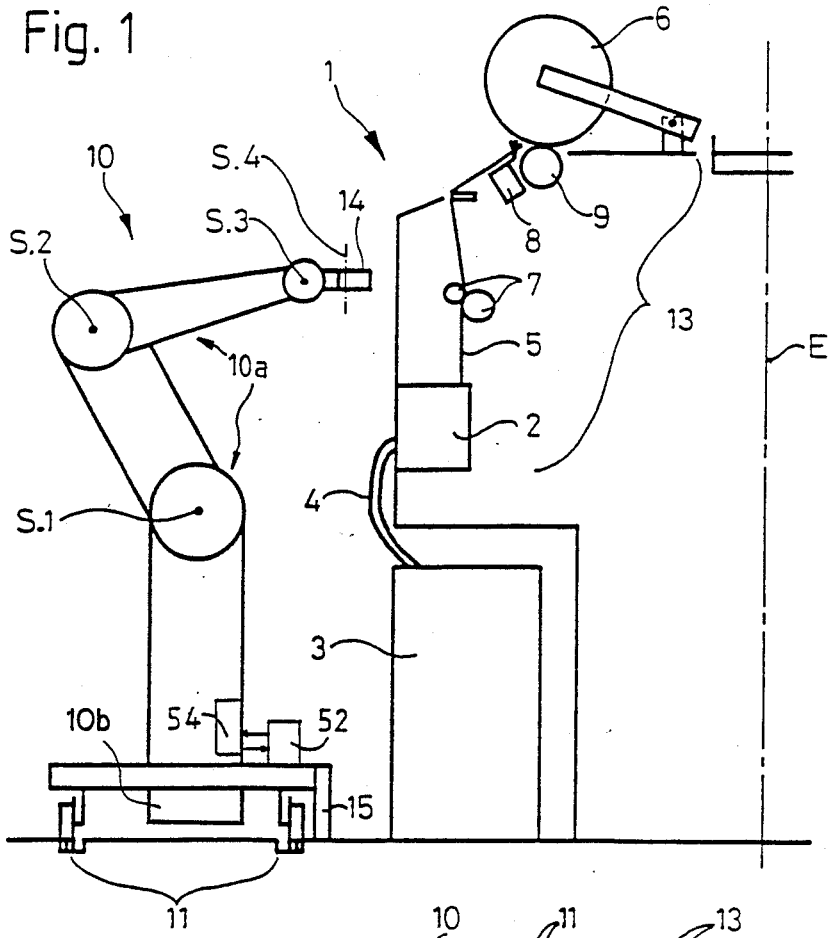
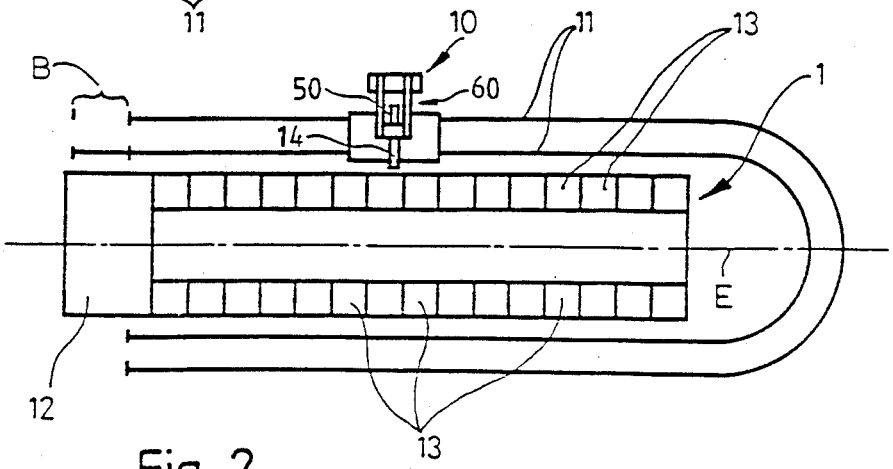
Fig. 2

APPARATUS FOR CLEANING A TEXTILE MACHINE COMPRISING A PLURALITY OF OPERATING POSITIONS

CROSS-REFERENCE TO RELATED CASE

This application is a divisional of my commonly assigned, copending U.S. application Ser. No. 07/087,790, filed Aug. 21, 1987, entitled "METHOD AND APPARATUS FOR CLEANING A TEXTILE MACHINE COMPRISING A PLURALITY OF OPERATING POSITIONS".

BACKGROUND OF THE INVENTION

The present invention relates to a new and improved apparatus for cleaning a textile machine, such as by way of example and not limitation a spinning machine, containing a plurality of operating positions, in that exemplary case a plurality of spinning positions.

As to the inventive cleaning apparatus for the cleaning of a plurality of typically similar operating positions of a textile machine, such cleaning apparatus comprises a movable or mobile cleaning device which is movable on rails or the like between the different operating positions and such movable or mobile cleaning device is provided with at least one suction trunk or nozzle.

A heretofore known cleaning apparatus of this general type is shown and described in German Pat. No. 1,510,728. In that case, elements of the individual spinning positions are freed of fiber particles deposited thereon by means of pressure jets of a cleaning device travelling on rails along the spinning machine. These fiber particles then pass in free flight onto the floor upon which the spinning machine is mounted or supported and from that location they are sucked away by a suction trunk also forming part of the cleaning device.

Other cleaning devices, operating in accordance with substantially the same technique or method, are known, for example, from U.S. Pat. Nos. 3,754,992 and 3,908,346. An important disadvantage of this prior art blow-suction technique or method resides in the fact that the fiber particles can be caught or entrained only indirectly by the suction nozzle, that is to say, by means of a transfer function This undesirably results in the possibility that the fiber particles blown away by the pressure jets, while on their way or during their flight to the floor or machine supporting structure, can remain entrapped or caught at machine parts or elements located above floor level yet outside the operating range or effective region of the pressure jets. Consequently, at least to some degree there is only effected a displacement of the impurities or contaminants which should be removed from the area of the textile machine.

Furthermore, the known cleaning devices constitute rather limited or non-versatile designs or constructions which are devoid of operational flexibility and adaptability to varying contours of the objects to be cleaned, in this case the parts or elements of the associated textile machine which is to be cleaned.

SUMMARY OF THE INVENTION

Therefore with the foregoing in mind it is a primary object of the present invention to provide an apparatus for cleaning a plurality of operating positions of a textile machine in a manner not afflicted with the aforementioned shortcomings and drawbacks.

A further significant object of the present invention aims at the removal of undesired contaminants or impurities, such as dirt or fiber particles, on the one hand, effectively and, on the other hand, directly from individual elements of the individual operating positions of a textile machine, such as for instance the spinning positions of a spinning machine.

Yet a further noteworthy object of the present invention aims at the provision of an improved apparatus for reliably cleaning a plurality of operating positions of a textile machine in a highly versatile and controlled manner and which apparatus is readily adaptable to the encountered conditions prevailing at the textile machine.

Still a further significant object of the present invention is directed to the provision of a cleaning apparatus for the reliable and relatively easy and positive cleaning of predeterminate individual elements at the operating positions of the textile machine with a suction cleaning apparatus employing a programmable suction trunk or nozzle, the movements of which can be positively controlled in close adaptation to the intended cleaning operation to be performed at the individual elements of the operating positions to effect a positive, intense and reliable suction removal of undesired impurities or the like from the operating positions.

Now in order to implement these and still further objects of the present invention which will become more readily apparent as the description proceeds, the method of cleaning a textile machine containing a plurality of similar operating positions, each of the similar operating positions containing individual elements which are to be suction cleaned, contemplates moving a travelling or mobile cleaning device comprising a programmable robot having at least one suction trunk or nozzle to preselected ones of the plurality of similar operating positions for suction cleaning each of the preselected operating positions by means of the programmable robot of the travelling cleaning device. There is controlled operation of the programmable robot of the travelling cleaning device in order to suction clean predeterminate ones of the individual elements of each of the preselected ones of the operating positions by moving the suction trunk of the programmable robot such as to selectively suction clean the predeterminate ones of the individual elements of each of the preselected ones of the similar operating positions which are to be cleaned.

It is advantageous to successively move the travelling cleaning device including the programmable robot thereof from one operating position to the next following operating position during the cleaning of the textile machine.

The invention contemplates programming the individual movements of the suction trunk or nozzle to effectuate suction cleaning of the predeterminate ones of the individual elements of each of the preselected ones of the similar operating positions which are to be cleaned. In this regard there can be used at least one program for controlling the individual movements of the suction trunk for each operating position and for each employed suction trunk. It is also possible to program individual movements of the suction trunk or nozzle such as to effectuate suction cleaning of all of the individual elements of each of the preselected ones of the similar operating positions which are to be cleaned.

Furthermore, it is possible to control operation of the programmable robot such that the programmable robot performs an operating cycle entailing automatically moving the programmable robot from a predetermined starting position to a first operating position and thereafter from operating position to operating position and after the last operating position back to said predetermined starting position. The operating cycle may comprise a first operating cycle routine and a second operating cycle routine, and the operation of the programmable robot may be controlled such that the programmable robot during the first operating cycle routine cleans only some of the individual elements to be cleaned at each operating position and during the second operating cycle routine suction cleans all individual elements to be cleaned at each operating position.

As already alluded to above, the invention is not only concerned with the aforementioned method aspects, but further pertains to an improved cleaning apparatus for the cleaning of the different operating positions of a textile machine. Such cleaning apparatus, as contemplated by the present invention, is manifested by the features that there is provided a cleaning device which is mobile or movable upon rails or rail means along the various or predeterminate ones of the operating positions of the textile machine. The cleaning device comprises a suction cleaning device containing a programmable robot equipped with a suction trunk or nozzle, and means serve for controlling operation of the programmable robot such that the suction trunk or nozzle thereof is selectively moveable to predeterminate ones of the individual elements of the operating positions to be suction cleaned.

Due to the practice of the teachings of the present invention there is realized the notable advantage that the parts or elements of the textile machine, such as those of the spinning unit influencing the spinning result are extensively maintained free of undesired contaminants or impurities, in particular free of fiber particles or fiber accumulations.

BRIEF DESCRIPTION OF THE DRAWINGS

The invention will be better understood and objects other than those set forth above will become apparent when consideration is given to the following detailed description thereof. Such description makes reference to the annexed drawings, wherein throughout the various figures of the drawings there have been generally used the same reference characters to denote the same or analogous components and wherein:

FIG. 1 schematically illustrates a section through approximately one-half or one side of a textile machine, here a spinning machine together with a cleaning apparatus constructed and operating in accordance with the present invention; and FIG. 2 schematically illustrates a plan view of the complete spinning machine of FIG. 1 together with the cleaning apparatus constructed and operating in accordance with the present invention and as shown in FIG. 1, both the spinning machine and the associated cleaning apparatus being depicted on a scale which is smaller in comparison with that used in the showing of FIG. 1.

DETAILED DESCRIPTION OF THE PREFERRED EMBODIMENTS

Describing now the drawings, it is to be understood that to simplify the showing thereof only enough of the structure of the inventive cleaning apparatus for cleaning a textile machine containing a plurality of typically generally similar or identical operating positions has been illustrated therein as is needed to enable one skilled in the art to readily understand the underlying principles and concepts of this invention. Turning attention now specifically to FIG. 1 of the drawings, there is depicted therein a textile machine, here for instance a spinning machine 1 containing a suitable spinning assembly or unit 2 in which a fiber sliver 4 extracted from a spinning or sliver can 3 is spun to a yarn or thread 5 which finally is wound up on a conventional bobbin or spool in order to form a yarn or thread package 6, as is well known in this technology.

Following the spinning assembly or unit 2, the yarn or thread 5 or the like is acted upon by a withdrawal roller pair 7 and is then delivered to a suitable yarn or thread traverse element 8 and by means of a friction or drive roller 9 to the bobbin or spool at which there is formed by winding the wound thread or yarn package 6.

The spinning machine 1 can be, for instance, any one of a rotor open-end spinning machine, a friction open-end spinning machine or an air-jet spinning machine. All three of these just-mentioned textile spinning machine types use known spinning methods or techniques and machine designs so that a more detailed description thereof need not be here undertaken, particularly since such details are not needed for understanding the underlying principles and concepts of the present invention.

Parallel to the symmetry plane E of the spinning machine 1, indicated in FIGS. 1 and 2 by dash-dotted lines, there is arranged a movable or mobile cleaning device 10 for cleaning the spinning machine 1. This movable or mobile cleaning device 10 is arranged to travel on rails or rail means 11 or equivalent guide structure under the action of drive means **10*b*** in order to achieve the movement substantially parallel to the symmetry plane E as described hereinafter.

As will be apparent from an inspection of FIG. 2, the rails 11 are disposed in substantially parallel relationship to one another and to the plane of symmetry E on both sides of this symmetry plane or plane of symmetry E but also extend around one end of the spinning machine 1, so that the cleaning device 10 can be effectively used on both sides of such spinning machine 1.

FIG. 2 also shows the opposite located spinning machine end equipped with the drive head 12 and schematically indicates, by means of the two rows of rectangles 13, the two rows of operating positions, here the spinning positions, each of which comprises the same elements as those depicted for the spinning machine 1 as illustrated in FIG. 1 and discussed previously with reference thereto. Each rectangle represents one spinning position.

The cleaning device 10 for cleaning the spinning positions 13 constitutes a known type of robot, generally indicated by reference character **10*a*, provided with a suction trunk or nozzle 14**, for example, as is commercially available from the well-known Swedish corporation ASEA.

It is known in practice that such robots are moveable with at least three degrees of freedom of motion or movement, and in the present case under discussion the direction of movement of the robot **10*a* substantially parallel to the symmetry plane E forms an additional degree of freedom of movement. The three degrees of freedom of movement of the illustrated robot 10*a* itself are defined by the robot moveability or mobility about the pivot axes S.1, S.2 and S.3. A still further degree of freedom of movement is defined by the pivotability of the suction trunk 14 of the robot 10*a* about the substantially vertical pivot axis S.4. The suction trunk 14 of the controllably movable robot 10***a* is thus capable of undertaking controlled motion which enables it to effectively reach objects or elements which are to be suction cleaned and which, seen from the viewpoint of the robot 10*a*, are not located in a directly visible position.

Furthermore, it is known that such robots are programmable in all their degrees of freedom of movement. Additionally, there can be readily programmed the desired movement or travel motion of the robot 10*a* on the rails 11.

The suction trunk or nozzle 14 also has an extension or prolongation 50 (FIG. 2) in the suction air direction, which trunk extension or prolongation 50 terminates or finally ends in a suitable dirt extractor or in a conventional underpressure generator (not shown) operatively connected thereto. This entire assembly is conveniently referred to as a suction device, merely generally indicated in FIG. 2 by reference character 60, which is operatively associated with the programmable and thus controllable robot 10*a*.

Before use of the programmable robot 10*a* and the associated suction device 60, this programmable robot 10*a* is precisely located at a spinning position 13 by means of a positioning element 15 provided at each spinning position 13. The programmable robot 10*a* is then caused to simulatingly move through various desired movements with respect to the individual elements at the spinning position 13 of the spinning machine 1. These robot movements, which simulate the desired movements of the programmable robot 10*a* during the actual cleaning of each of the spinning positions 13 of the spinning machine 1, are then inputted in the form of appropriate electrical signals to the control computer 52 and programmed therein. Since the individual elements at each spinning position 13 are identical the established program now appearing at the control computer or computer 52 can be used for performing the same suction cleaning operation at each of the similar or identical spinning positions 13. There also can be conventionally programmed the further travel of the programmable robot 10*a* to the immediately next or next desired spinning position 13 and return travel of the programmable robot 10*a* to a predetermined starting position B (FIG. 2) after the cleaning operation has been carried out at all spinning positions 13, and possibly waiting at the starting position B until receiving a new start command for again performing the desired suction cleaning operation; this is generally conveniently designated an operating cycle. Furthermore, emptying of the dirt extractor into a suitable collector duct (not shown) is also carried out at this robot starting position B.

As a refinement in the operation of the system there obviously could be obtained a number of different cleaning programs for each spinning position by appropriately simulatingly moving the programmable robot 10*a* in the aforedescribed manner to predeterminate individual elements at the associated spinning position 13, for instance a program entailing only cleaning, for example, the spinning unit 2 and the withdrawal roller pair 7. There thus would be available at the computer 52 a number of different possible cleaning programs for cleaning the spinning positions 13 depending upon the type and intensity of the cleaning operation intended for the spinning positions 13.

After programming the desired operation of the programmable robot 10*a* by undertaking the aforedescribed procedures, the programmable robot 10*a* can be set in operation for carrying out the desired operating cycle by means of a control device 54 operatively associated with the control computer 52 and provided for the programmable robot 10*a*.

In keeping with the foregoing explanations and as a modification of the initially explained operation of the cleaning device 10 and the programmable robot 10*a* thereof, the suction cleaning program can be perfected such that the programmable robot 10*a* performs suction cleaning during one or a first operating cycle or operating cycle routine, for example only on those individual elements of the preselected operating positions which are most prone to fouling by contaminants or impurities, such as dust or fiber accumulations. Then during the next succeeding operating cycle or operating cycle routine, however, all elements of each spinning position 13 to be cleaned are again subjected to the suction cleaning operation.

Basically, other variations in the operation of the cleaning apparatus can also be readily carried out by simply establishing a suitable program or programs as will obviously suggest themselves to those skilled in the art, so that the invention is not to be construed in any way as limited to the described programs or program combinations.

Equally, the method or the cleaning apparatus of the present development, or both, can be used on other textile or spinning machines, for example ring spinning machines, winders, roving frames or on other quite different types of textile machines generally, where these textile machines have a row of similar or identical operating positions (called spinning positions in spinning machines).

Furthermore, the invention is not limited to the use of a programmable robot travelling on floor-mounted rails. A so-called "head-down" version, in which the rails or robot travel or support means are mounted in a ceiling structure or the like and the programmable robot is suspended head-down from its foot portion, can also be used for carrying out the method.

Furthermore, the programmable robot 10*a* can also be used for servicing a plurality of spinning machines.

While there are shown and described present preferred embodiments of the invention, it is to be distinctly understood that the invention is not limited thereto, but may be otherwise variously embodied and practiced within the scope of the following claims. accordingly,

What I claim is:

1. An apparatus for cleaning a textile machine containing a plurality of operating positions each of which contains individual elements to be suction cleaned, comprising:

a cleaning device;

drive means for controllably moving said cleaning device along the plurality of operating positions and to preselected ones of the plurality of operating positions;

said cleaning device comprising a suction cleaning device;

said suction cleaning device comprising a programmable robot equipped with a suction trunk;

said programmable robot containing programmable control means programmed for controlling the drive means for controllably moving said cleaning device and the suction cleaning operation of the programmable robot at the preselected operating positions;

said programmable control means controlling the suction cleaning operation by controlling individual selective movements of said suction trunk, at each one of said preselected operating positions, to predetermine ones of the individual elements for carrying out the suction cleaning operation; and said suction trunk being selectively and pivotably moveable under the control of said programmable control means about at least two mutually substantially parallel axes and at least one axis extending substantially perpendicular to said at least two mutually substantially parallel axes.

2. The apparatus as defined in claim 1, wherein:

said at least two mutually substantially parallel axes about which said suction trunk is selectively and pivotably moveable, extend substantially parallel to said plurality of operating positions.

3. The apparatus as defined in claim 1, wherein:

said at least two mutually substantially parallel axes about which said suction trunk is selectively and pivotably moveable, extend in substantially horizontal direction; and said at least one axes extending substantially perpendicular to said at least two mutually substantially parallel axes, constituting a substantially vertical axis.

4. The apparatus as defined in claim 1, further including:

a suction nozzle connected to said suction trunk;

said suction nozzle being pivotably moveable, under the control of said programmable control means, about a pivot axis extending substantially parallel to said at least two substantially mutually parallel axes; and said suction nozzle being further pivotably moveable, under the control of said programmable control means, about said at least one axis extending substantially perpendicular to said at least two mutually substantially parallel axes.

5. The apparatus as defined in claim 1, wherein:

said programmable control means control the drive means for controllably moving said cleaning device such that said cleaning device is successively moved, after completion of the programmed suction cleaning operation at one of said preselected operating positions, from said preselected operating position to a further preselected, next following operating position for carrying out the programmed suction cleaning operation at said further preselected next following operating position.

6. The apparatus as defined in claim 1, wherein:

said programmable control means contains at least one program for controlling individual selective movements of said suction trunk for carrying out said suction cleaning operation at each one of said preselected operating positions.

7. The apparatus as defined in claim 1, wherein:

said programmable control means controls, as said individual selective movements of said suction trunk, individual selective movements of said suction trunk to the entirety of said individual elements to be suction cleaned at each one of said preselected operative positions.

8. The apparatus as defined in claim 1, wherein:

said programmable control means controls the drive means for driving said cleaning device through an operating cycle; and said operating cycle defining a predetermined starting position and a sequence of operating positions containing a first operating position following said predetermined starting position and a last operating position preceding return to said predetermined starting position.

9. The apparatus as defined in claim 8, wherein:

said operating cycle comprises a first operating cycle routine and a second operating cycle routine;

said programmable control means controlling the suction cleaning operation at preselected ones of said individual elements at each one of said sequence of operating positions during said first operating routine; and said programmable control means controlling the suction cleaning operation at all of the individual elements at each one of said sequence of operating positions during said second operating cycle routine.

10. An apparatus for cleaning a spinning machine containing a plurality of essentially identical operating positions each of which contains individual elements to be suction cleaned, comprising:

a travelling cleaning device;

drive means for controllably driving said travelling cleaning device along the plurality of essentially identical operating positions and to preselected ones of said plurality of essentially operating positions;

said travelling cleaning device comprising a suction cleaning device;

said suction cleaning device comprising a programmable robot equipped with a suction trunk;

said programmable robot containing programmable control means programmed for controlling the suction cleaning operation of the programmable robot at the preselected essentially identical operating positions;

said programmable control means for controlling the suction cleaning operation, controlling individual selective movements of said suction trunk, at each one of said preselected essentially identical operating positions, to predeterminate ones of the individual elements for carrying out the suction cleaning operation; and said suction trunk being selectively and pivotably moveable under the control of said programmable control means at least three degrees of freedom of pivoting movement about respective pivot axes at least one of which extends substantially perpendicular to the remaining axes which are mutually substantially parallel to each other.

11. A spinning machine, comprising:

a plurality of essentially identical operating positions;

each one of said essentially identical operating positions containing a predetermined number of individual elements which are to be suction cleaned;

a travelling cleaning device;

drive means for controllably driving said travelling cleaning device along the plurality of essentially identical operating positions and to preselected ones of said plurality of essentially identical operating positions;

said programmable robot containing programmable control means programmed for controlling the suction cleaning operation of the programmable robot at the preselected essentially identical operating positions;

said programmable control means for controlling the suction cleaning operation, controlling individual selective movements of said suction trunk, at each one of said preselected essentially identical operating positions, to predeterminate ones of the individual elements for carrying out the suction cleaning operation; and said suction trunk being selectively and pivotably moveable under the control of said programmable control means in at least three degrees of freedom of pivoting movement about respective pivot axes at least one of which extends substantially perpendicular to the remaining axes which are mutually substantially parallel to each other.

12. The spinning machine as defined in claim 11, wherein:

said predetermined number of individual elements at each one of said preselected essentially identical operating positions, encompass certain individual elements which are differently structured and perform a different operating function as compared to other individual elements; and said programmable control means controlling the individual selective movements of said suction trunk for suction cleaning said predeterminate individual elements, controlling individual selective movements of said suction trunk to said certain individual elements which are differently structured and perform a different operating function as compared to other individual elements at each one of said preselected essentially identical operating positions.

13. The spinning machine as defined in claim 12, wherein:

said certain individual elements are located at mutually different elevational positions relative to each other.

* * * * *

UNITED STATES PATENT AND TRADEMARK OFFICE

CERTIFICATE OF CORRECTION

PATENT NO. : 4,864,679

DATED : September 12, 1989

INVENTOR(S) : EMIL BRINER

It is certified that error appears in the above-identified patent and that said Letters Patent is hereby corrected as shown below:

Column 8, line 28, after "essentially" please insert --identical--

Signed and Sealed this

Thirteenth Day of November, 1990

*Attest:*

HARRY F. MANBECK, JR.

*Attesting Officer*

*Commissioner of Patents and Trademarks*